United States Patent [19]

Krokaugger

[11] Patent Number: 4,885,508

[45] Date of Patent: Dec. 5, 1989

[54] SYSTEM FOR CONTROLLING THE INTENSITY OF HIGH POWER LIGHTS

[75] Inventor: William G. Krokaugger, Chatsworth, Calif.

[73] Assignee: Mole-Richardson Company, Hollywood, Calif.

[21] Appl. No.: 203,517

[22] Filed: May 5, 1988

Related U.S. Application Data

[63] Continuation of Ser. No. 925,322, Oct. 31, 1986, abandoned.

[51] Int. Cl.[4] ..... H05B 41/16; H05B 41/24

[52] U.S. Cl. ..... 315/287; 315/293; 315/DIG. 4

[58] Field of Search ..... 315/208, 226, 287, 307, 315/293, DIG. 4, DIG. 7

[56] References Cited

U.S. PATENT DOCUMENTS

| | | | |
|---|---|---|---|
| 3,681,654 | 8/1972 | Quinn | 315/DIG. 4 |
| 3,986,022 | 10/1976 | Hyatt | 315/151 |
| 4,291,254 | 9/1981 | Arlt et al. | 315/307 |
| 4,450,384 | 5/1984 | Krokangger . | |

*Primary Examiner*—Benedict V. Safourek
*Assistant Examiner*—T. Salindong
*Attorney, Agent, or Firm*—Edward A. Sokolski

[57] ABSTRACT

An electronic control system employing logical control for controlling a gas vapor arc globe. Power from a power source such as an AC power line or DC or AC generator is connected by a control switch to a logical control circuit which initially activates the igniter for the globe. In the event that the igniter does not cause the globe to ignite a control signal is provided to turn the power off. The voltage for operating the globe is boosted by means of a boost voltage generator to a substantially higher voltage than that of the power source. The operating voltage for the globe is generated by means of a multivibrator which runs at a relatively low frequency and a pulse width modulator which runs at a high audio frequency. The square wave output of the multivibrator (typically 60 Hz) is modulated by the pulse output of the pulse width modulator (typically 20 KHz) to provide a square wave DC to the globe modulated by high frequency rectangular pulses having a width which determines the intensity of the globe. The width of the output pulses of the pulse width modulator can be changed as desired to adjust this intensity. The frequency of the pulse width modulator is high enough so that the light intensity of the globe will remain constant to the eye. Further, feedback control circuitry is employed so as to maintain such intensity constant with fluctuations in line voltage.

3 Claims, 4 Drawing Sheets

SYSTEM FOR CONTROLLING THE INTENSITY OF HIGH POWER LIGHTS

This application is a continuation of Ser. No. 925,322, filed Oct. 31, 1986, now abandoned.

This invention relates to control systems for controlling the intensity of high power lights and more particularly such a system employing electronic circuitry which is suitable for maintaining the intensity of gas vapor arc lights substantially constant.

High intensity illumination is generally provided on movie and television sets and outdoor locations by means of high intensity gas vapor arc lights commonly known in the industry as HMI globes. Several problems have been encountered in the use of this type of lighting. First it is essential that flicker and other variations in the intensity of the lights be minimized if not entirely eliminated in view of the adverse effects that such variations produce in the output of the video or movie camera. Further, where several of such globes are utilized, it is important that these globes be adjusted to the same color temperatures and so maintained after initially adjusted in view of the adverse effects that differing light color outputs from different globes produces.

Typical systems used for controlling the intensity of high power arc lights have generally involved the use of magnetic ballast controls which are used to adjust the current fed to the globes. Such ballast devices generally operate with AC power and provide a sine wave output. The sine wave current fed to the globe can result in flicker which can be picked up by the camera. Further, such magnetic ballast control systems are not adapted to fully account for fluctuations in line voltage which produce corresponding variations in light intensity.

The system of the present invention obviates the aforementioned shortcomings of the prior art in providing an electronic control system which may employ solid state components wherein accurate voltage and current control is employed to minimize the effects of line voltage fluctuations. Further, rather than utilizing the AC line voltage to drive the globe, the system of the present invention employs a high frequency rectangular wave drive current, the intensity of such globe being controlled by controlling the width of the rectangular pulse output of the oscillator which may comprise a pulse width modulator which controls this drive current. The frequency of the rectangular wave is high enough so that no flicker is produced. Further, the average current in the globe is controlled as a function of the width of the pulse output of the pulse width modulator which can be precisely regulated and adjusted as may be desired to control the light intensity. The system of the present invention has the additional advantage of providing a voltage boost circuit which substantially raises the voltage from the power source to provide higher drive voltage for the globe. In addition interlocks are provided in the system to shut the system down in the event that the globe is not ignited by the igniter.

It is therefore an object of this invention to minimize the flicker in high intensity arc lighting systems used in movie and television work.

It is a further object of this invention to minimize color temperature variations gas vapor arc in globes employed in television and movie applications.

It is still a further object of this invention to provide an electronic control system for controlling the intensity of high power arc globes employed in television and movie work.

Other objects of this invention will become apparent as the description in connection with the accompanying drawings of which:

The system of the invention employs a logical control circuit which checks to determine whether or not the globe has been ignited and the proper voltages for controlling the system have been generated. After the globe has been ignited, the igniter is shut off. A booster circuit is provided to boost the input line voltage to a substantially higher voltage for generating the globe current. This higher voltage is converted to a low frequency square wave which is employed to provide current through the globe alternately in opposite directions. This square wave is modulated by a high frequency rectangular wave such that current is provided within the envelope of the square wave in a series of high frequency pulses. The high frequency pulses are generated by a controlled pulse width modulator such that their width can be adjusted and regulated thereby effectively controlling the average current supplied to the globe and thus the light intensity of such globe. The pulse width of the output of the pulse width modulator is accurately controlled by means of feedback control circuitry so as to maintain the current fed to the globe constant. The frequency of the current pulses is high enough so as to produce no flicker in the light output of the globe. Further, the control circuitry employed minimizes changes in intensity with fluctuations in line current.

Figure 1:
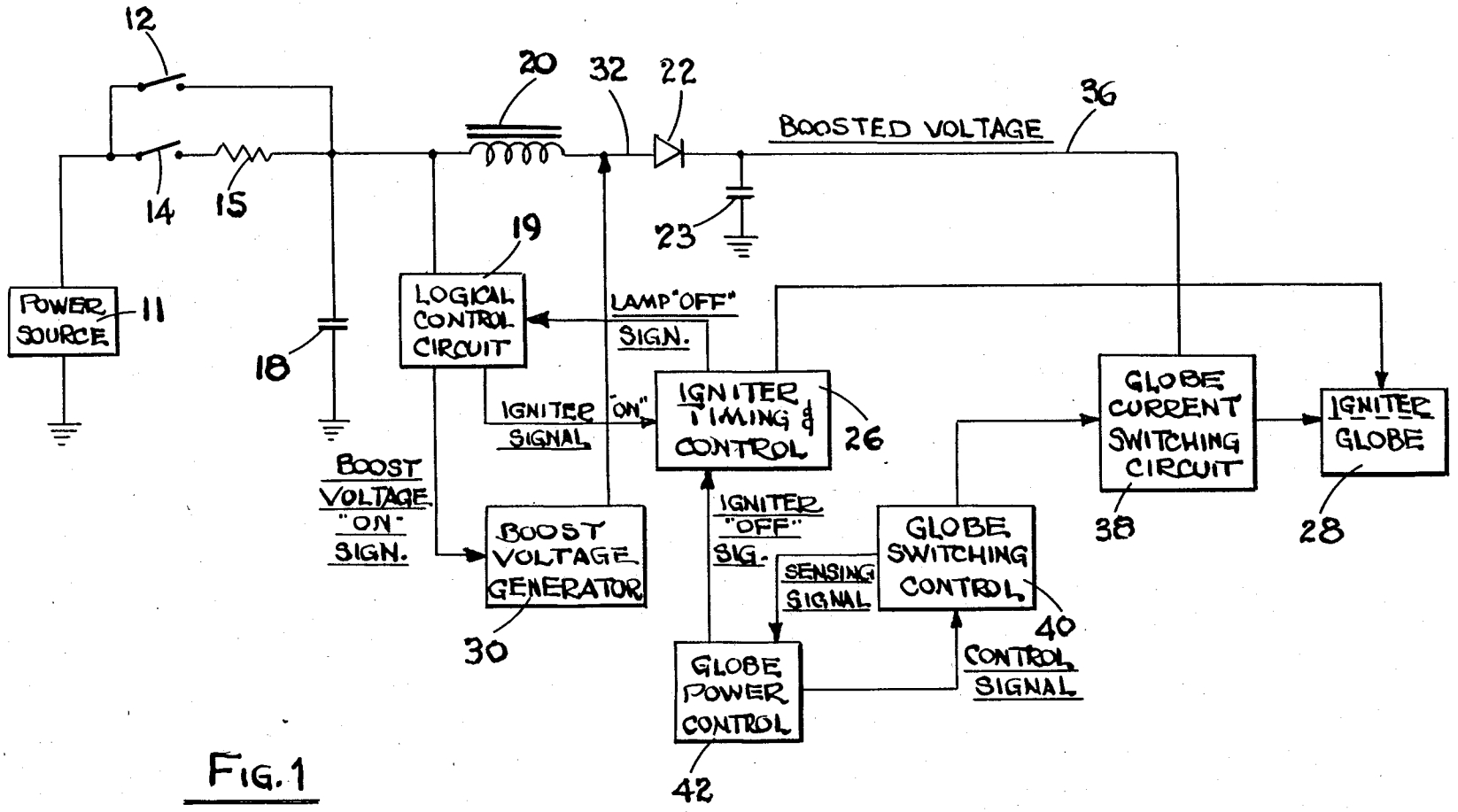
FIG. 1 is a functional block diagram of the system of the invention.

Referring now to FIG. 1 a functional block diagram of the system of the invention is shown. The system is turned on by closing switch 14 which provides power from power source 11 which may be the line voltage or the output of a AC or DC generator. The current passes through current limiting resistor 15, inductor 20 and diode 22 to filter capacitor 23. It is to be noted that the output of power source 11 is DC. If the AC power line is to be utilized, a rectifier and filter is employed at the input to the system. As to be explained further on in the specification, switch 14 may operate in conjunction with a momentary contact switch and a relay, and when the proper operation of the system has been verified by logical control circuit 19, this switch is bypassed by a relay controlled switch 12, thereby bypassing protective current limiting resistor 15.

Logical control circuit 19 sends a signal to igniter timing and control 26 to enable this circuit to ignite globe 28, provided that proper conditions, as verified by the logical control circuit 19, exist. Logical control circuit 19 also provides a signal to boost voltage generator 30 to enable this generator to provide a boost voltage to line 32 to boost the voltage output of power source 11. Typically the boost voltage may be 155 volts which when added to a line voltage of 120 volts makes for a total voltage of 275 volts. This boosted voltage appears across capacitor 23 and on buss 36.

Globe 28, after it is ignited, is provided with high frequency pulses of current from the boosted voltage on line 36 by means of globe current switching circuit 38.

Switching circuit 38 is in turn controlled by globe switching control 40 which as to be explained further on in the specification may comprise a low frequency square wave generator (multivibrator) the output of which is modulated by high frequency pulses generated by a pulse width modulator. The width of these pulses is adjustable so as to control the illumination of the globe and is maintained constant by appropriate control circuitry once it is set at a predesired point. The frequency of the square wave generator (multivibrator) is typically 60 Hz while that of the pulse width modulator (PWM) is typically 20 KHz. A sensing signal is provided from globe switching control 40 to globe power control 42 indicating when the globe is ignited. Globe power control 42 provides an igniter "off" signal to igniter timing and control 26 in response to this sensed signal thereby deactivating the igniter.

Figure 2A:
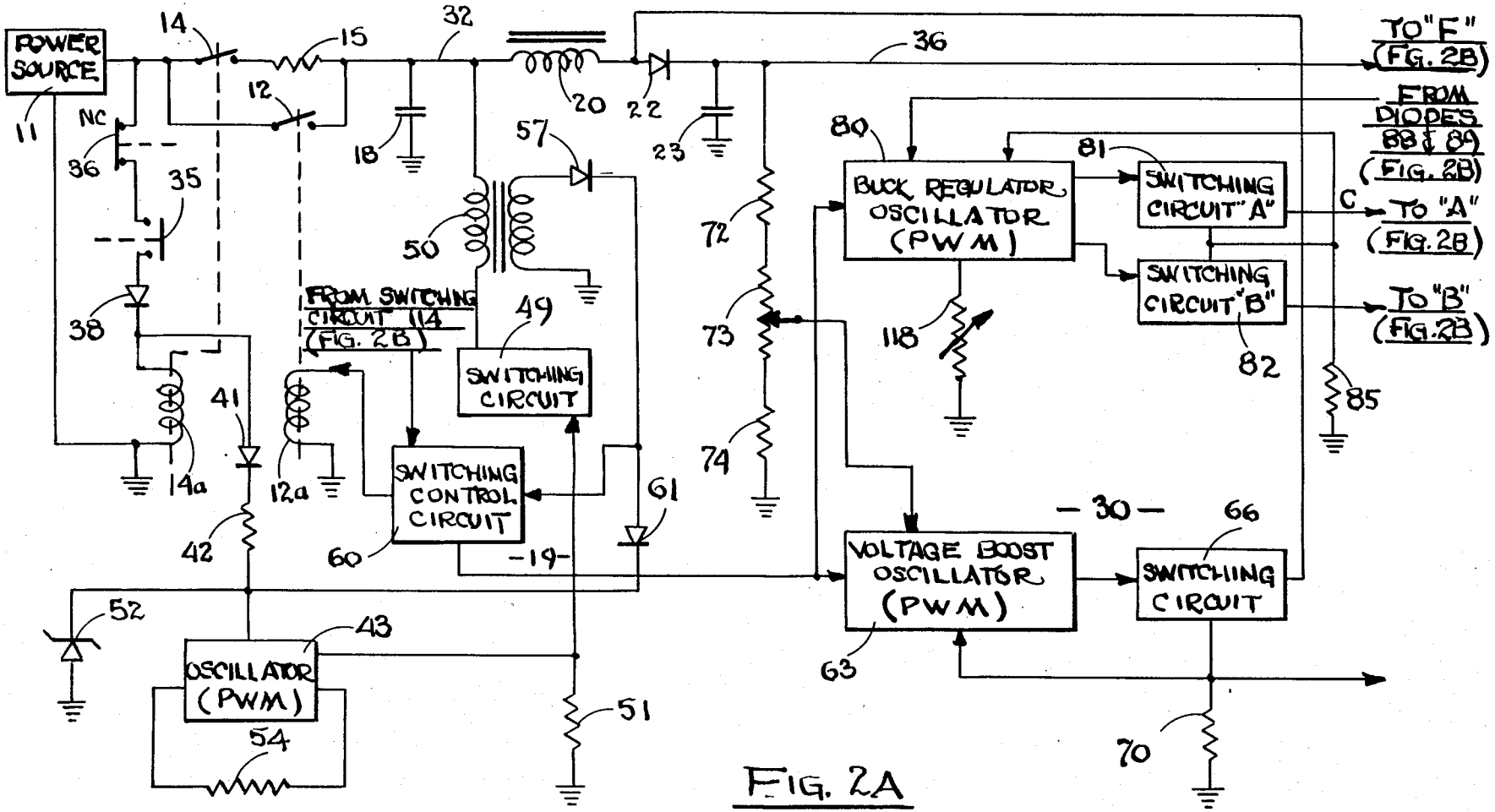
FIGS. 2A and 2B are a functional schematic drawing illustrating a preferred embodiment of the invention.
Figure 2B:
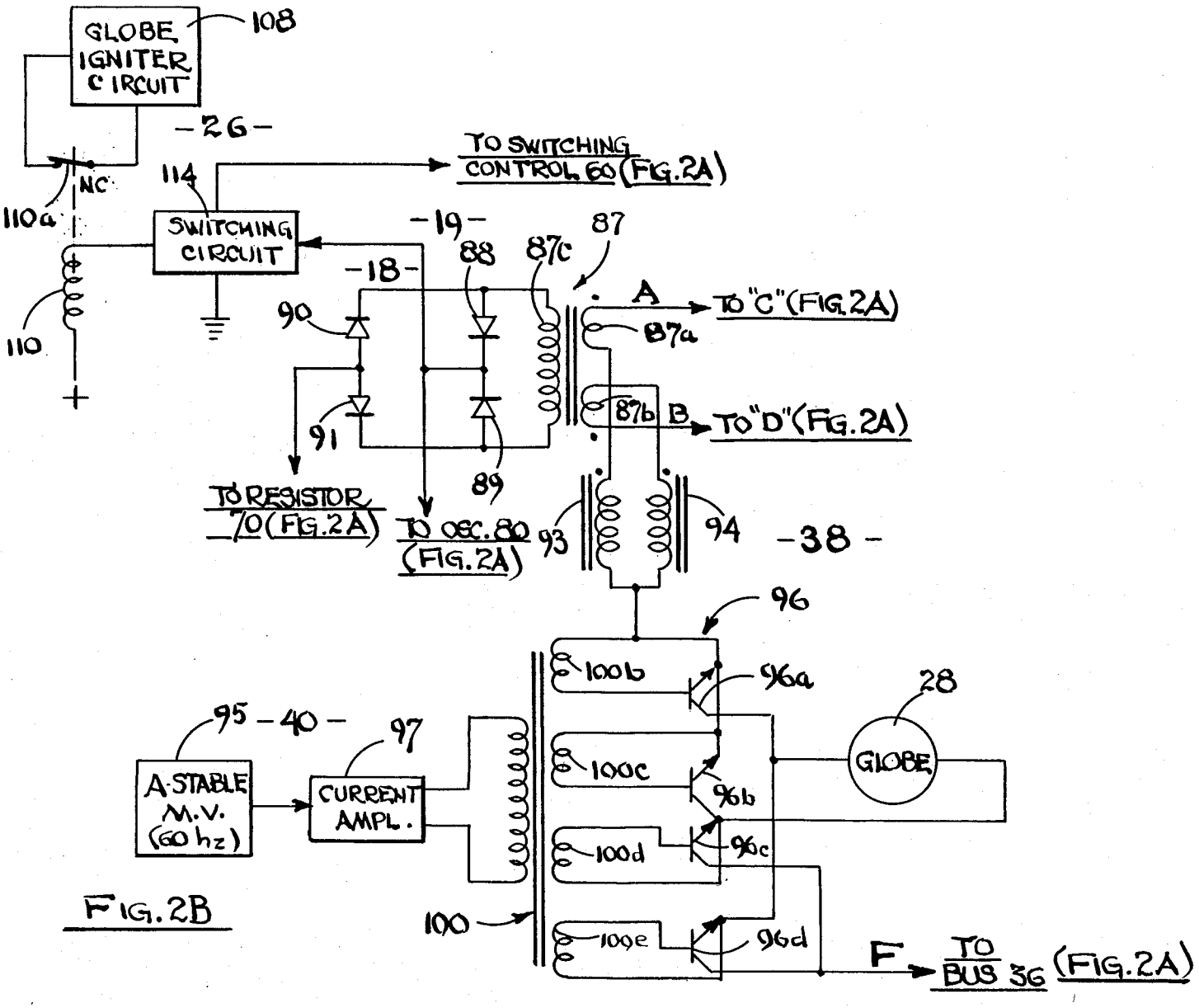

Referring now to FIGS. 2A and 2B, a preferred embodiment of the invention is schematically illustrated. With the momentary actuation of switch 35, power is supplied from power source 11 through normally closed switch 36 and diode 38 to relay 14*a*, causing switch contact 14 to close. This supplies power through current limiting resistor 15 and inductor 20 and diode 22 to filter capacitor 23. At the same time current flows through diode 41 and resistor 42 to oscillator (PWM) 43, thereby activating this oscillator which may comprise a pulse width modulator. The output of oscillator 43 is fed through switching circuit 49, which may comprise a switching transistor, to the primary of transformer 50 which is connected to power buss 32. Oscillator 43 operates in conjunction with negative feedback resistor 54 and negative feedback from resistor 51 so as to regulate its pulse width to maintain a predetermined DC voltage (typically 24 volts) at the cathode of diode 57. When this predetermined voltage is present, switching control circuit 60 is activated to energize relay 12*a* causing relay contact 12 to close thereby bypassing current limiting resistor 15.

Power to continue the operation of voltage regulating oscillator 43 is provided through diode 61, the initial power for operating this circuit having been provided with the momentary actuation of switch contact 35. With the predetermined voltage (24 volts) present at the output of diode 57 an enabling signal is fed from switching control circuit 60 to voltage boost oscillator 63, enabling this oscillator to operate. Voltage boost oscillator 63 may comprise a pulse width modulator which drives switching circuit 66 which may comprise a transistor. When switching circuit 66 is activated, current flows through inductor 20, switching circuit 66 and resistor 70. In view of the pulsating output of oscillator 63, which operates at a frequency of the order of 20 KHz, surges of current successively pass through inductor 20 these surges of current ("di/dt") generating a "boost" voltage which passes through diode 22 and appears across capacitor 23 on top of the line voltage provided from power source 11. In an operative embodiment of the invention, line voltage of 120 volts is boosted in this manner to 275 volts.

A feedback voltage is provided from resistor 70 to oscillator 63 to stabilize the output of the oscillator. This output is further stabilized by means of the voltage divider network including resistors 72, 73 & 74, resistor 73 being variable to enable manual adjustment of the boosted DC voltage.

Buck regulator oscillator 80 is a pulse width modulator which operates at a high audio frequency (of the order of 20 KHz). The output of oscillator 80 alternately drives switching circuit "A" 81 and switching circuit "B" 82. These two switching circuits thus are alternately switched on and off in accordance with the pulse width of the output of the oscillator. The outputs of switching circuits 81 and 82 are fed to transformer windings 87*a* and 87*b* respectively of transformer 87. The current fed to windings 87*a* and 87*b* is sensed in winding 87*c* of transformer 87. Diodes 90 and 91 form a full wave bridge rectifier with diodes 88 and 89. The current is fed from the cathodes of diodes 88 and 89 to oscillator 80 as a negative feedback signal to regulate the oscillator's duty cycle and thus the pulse width of the output of the oscillator. Negative feedback is also provided to oscillator 80 from resistor 85. The feedback from resistor 85 in effect provides current feedback while the feedback from diodes 88 and 89 effectively provides voltage feedback. The rectified output is fed from diodes 90 and 91 to resistor 70 to provide additional feedback current. The high frequency pulse outputs fed to transformer windings 87*a* and 87*b* are fed through chokes 93 and 94 respectively to transistor bridge circuit 96, the operation of which will now be described.

Figure 3:
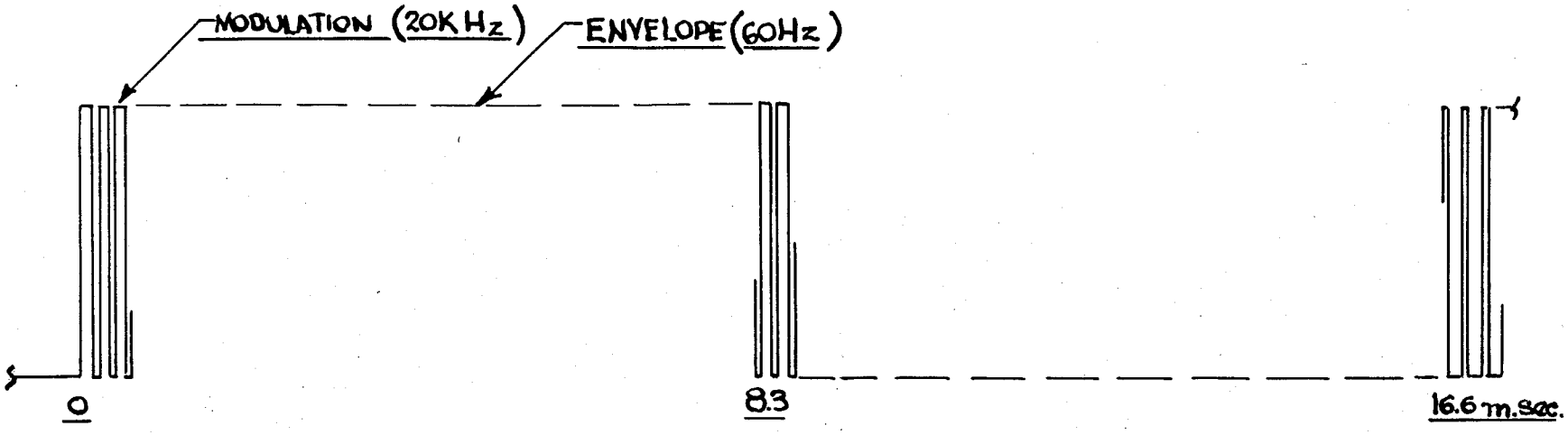
FIG. 3 is a wave form diagram illustrating the operation of the preferred embodiment.

Astable multivibrator 95 has a low frequency output (of the order of 60 Hz) which is fed to current amplifier 97 which provides current pulses to the primary winding 100*a* of transformer 100. Transformer 100 has four secondary windings 100*b*–100*e* each of which drives a separate transistor 96*a*–96*d* of transistor bridge circuit 96. The outputs of transistors 96*a*–96*d* are fed to arc globe 28 to provide current through the globe alternatively in opposite directions in response to the square wave excitation signal provided by astable multivibrator 95. This square wave current signal is modulated by the high frequency output pulses fed to the bridge from transformer windings 87*a* and 87*b* through chokes 93 and 94 as shown in FIG. 3. This is by virtue of the fact that windings 87*a* and 87*b* are in the return current path of the globe which runs through switching circuits 81 and 82 and resistor 85 to the common "ground" buss. Thus, the current through the globe is a function of the width of the high frequency pulses modulating the square wave. Power to the bridge for driving the globe is provided at point "F" from the boosted voltage bus 36. It is to be noted that the high frequency pulsating current fed to the globe never goes to zero but rather pulses from an intermediate voltage in view of the current lag provided by chokes 93 and 94.

Globe 28 employs an igniter circuit 108 which is used to ignite the globe. Control circuitry is provided for such ignition as now to be explained. When the globe ignites, as already noted, current is fed to winding 87*c* of current sensing transformer 87. This results in a DC output current through diodes 88 and 89. This current is fed to switching circuit 114, activating this circuit which in turn activates relay 110. The contact 110*a* of relay 110 is in series with the globe igniter circuit 108 which provides the igniter voltage to the globe. Contact 110*a* is normally closed and thus when the relay is activated, the globe igniter circuit is deactivated. If the globe fails to ignite, a signal is provided from switching circuit 114 to switching control circuit 60 causing this switching control circuit to deactivate relay 12*a* thereby opening contact 12 and turning off the power.

The intensity of globe 106 is controlled by manually operated variable resistor 118 which controls the pulse width of the output of buck regulator oscillator 80 and thereby controls the average current in the globe.

While the invention has been described and illustrated in detail, it is clearly understood that this is intended by way of illustration and example only and is not to be taken by way of limitation, the spirit and scope of this invention being limited only by the terms of the following claims.

I claim:

1. A system for controlling the intensity of a gas vapor arc globe comprising:

a source of DC power, low frequency oscillator means for generating a low frequency square wave;

first switching circuit means connected to said source of DC power and said low frequency oscillator means and responsive to the square wave output of said low frequency oscillator means for alternately feeding current through said globe in opposite directions, high frequency oscillator means for generating a rectangular wave having a duty cycle and width at a high audio frequency, the rectangular wave output of said high frequency oscillator means being fed to said switching circuit means to pulse width modulate the square wave envelope output of said low frequency oscillator means in a series of pulses at said high audio frequency, and means for varying the duty cycle and width of the rectangular wave of said high frequency oscillator means thereby controlling the current fed to said globe and the intensity thereof.

2. A system for controlling the intensity of a gas vapor arc globe comprising;

a source of DC power, low frequency oscillator means comprising an astable multivibrator for generating a low frequency square wave;

first switching circuit means connected to said source of DC power and said low frequency oscillator means and responsive to the square wave output of said low frequency oscillator means for alternately feeding current through said globe in opposite directions, high frequency pulse width modulator means for generating a rectangular wave having a duty cycle and width at a high audio frequency, the rectangular wave output of said pulse width modulator means being fed to said switching circuit means to pulse width modulate the square wave envelope output of said low frequency oscillator means in a series of pulses at said high audio frequency, means for varying the duty cycle and width of the rectangular wave of said high frequency oscillator means thereby controlling the current fed to said globe and the intensity thereof, and means for boosting the voltage of said source of DC power to provide a boosted voltage to said globe comprising an oscillator operating at a high audio frequency, an inductor connected in the current path of said first switching circuit means, and second switching circuit means responsive to the output of said oscillator and connected in a current path with said inductor, said second switching means effecting periodic surges of current through said inductor at said high audio frequency thereby generating said boosted voltage.

3. A system for controlling the intensity of a gas vapor arc globe comprising:

a source of DC power, low frequency oscillator means comprising an astable multivibrator for generating a low frequency square wave;

first switching circuit means connected to said source of DC power and said low frequency oscillator means an responsive to the square wave output of said low frequency oscillator means for alternately feeding current through said globe in opposite directions, high frequency pulse width modulator means for generating a rectangular wave having a duty cycle and width at a high audio frequency, the rectangular wave output of said pulse width modulator means being fed to said switching circuit means to pulse width modulate the square wave envelope output of said low frequency oscillator means in a series of pulses at said high audio frequency, means for controlling the duty cycle and width of the rectangular wave of said high frequency oscillator means thereby controlling the current fed to said globe and the intensity thereof, means for boosting the voltage of said source of DC power to provide a boosted voltage to said globe comprising an oscillator operating at a high audio frequency, and inductor connected in the current path of said first switching circuit means, and second switching circuit means responsive to the output of said oscillator and connected in a current path with said inductor, said second switching means effecting periodic surges of current through said inductor at said high audio frequency thereby generating said boosted voltage, a current limiting resistor in series with the current path of said first switching circuit means, logical control circuit means for bypassing said limiting resistor in response to a signal indicating that a predetermined operating voltage has been established, án ignitor circuit for igniting the globe, and means for deactivating said ignitor circuit once the globe has been ignite and deactivating the source of DC power should the globe fail to ignite after a predetermined period of time comprising current sensing means for sensing that current is being fed to said globe and third switching circuit means responsive to said current sensing means for disabling the ignitor circuit.

* * * * *